US007458888B2

(12) United States Patent
Huta

(10) Patent No.: US 7,458,888 B2
(45) Date of Patent: Dec. 2, 2008

(54) CHIMNEY TERMINATION CAP

(76) Inventor: Robert M. Huta, 55 Michaywe Dr., Gaylord, MI (US) 49735

( * ) Notice: Subject to any disclaimer, the term of this patent is extended or adjusted under 35 U.S.C. 154(b) by 0 days.

(21) Appl. No.: 11/679,558

(22) Filed: Feb. 27, 2007

(65) Prior Publication Data

US 2008/0207105 A1 Aug. 28, 2008

(51) Int. Cl.
*F23L 17/02* (2006.01)
*F23L 17/14* (2006.01)
*F23J 13/08* (2006.01)

(52) U.S. Cl. ..... 454/37; 454/4; 454/8; 454/36; 454/38; 454/41

(58) Field of Classification Search ..... 454/3, 454/8, 12, 36, 37, 38, 40, 41, 33, 34, 35, 454/39, 4
See application file for complete search history.

(56) References Cited

U.S. PATENT DOCUMENTS

| | | | | | |
|---|---|---|---|---|---|
| 217,712 | A | | 7/1879 | Smith | |
| 277,457 | A | * | 5/1883 | Campbell | 96/377 |
| 852,480 | A | * | 5/1907 | Whitehead | 454/36 |
| 1,759,830 | A | | 5/1930 | Blanchard | |
| 2,300,128 | A | * | 10/1942 | Mattes | 454/12 |
| 2,510,901 | A | * | 6/1950 | Parker | 454/39 |
| 2,626,557 | A | * | 1/1953 | Hersch | 454/33 |
| 2,766,678 | A | * | 10/1956 | Morris | 454/12 |
| 2,781,716 | A | * | 2/1957 | Moran | 454/37 |
| 2,818,060 | A | | 12/1957 | Field | |
| 2,998,764 | A | | 9/1961 | Bedell et al. | |
| 3,040,734 | A | | 6/1962 | Field | |
| 3,315,586 | A | | 4/1967 | Marrapese et al. | |
| 3,361,051 | A | | 1/1968 | Fair et al. | |
| 3,399,617 | A | * | 9/1968 | Gray | 454/38 |
| 3,430,549 | A | | 3/1969 | Hershey et al. | |
| 3,435,816 | A | | 4/1969 | Werth | |
| 3,543,670 | A | * | 12/1970 | Stone | 454/367 |
| 3,650,198 | A | * | 3/1972 | Stone | 454/37 |
| 3,662,735 | A | | 5/1972 | Jackson | |
| 3,691,930 | A | | 9/1972 | Steinman | |

(Continued)

FOREIGN PATENT DOCUMENTS

EP 322936 A2 * 7/1989

(Continued)

OTHER PUBLICATIONS

Security Chimneys International, "Installation Instructions for Chase Termination Models FTF8-CT1 and FTF10-CT1 (63|48 and 63|49)," 750,015m, Nov. 2003, pp. 1-4.

*Primary Examiner*—Steven B McAllister
*Assistant Examiner*—Patrick F. O'Reilly, III
(74) *Attorney, Agent, or Firm*—Brooks Kushman P.C.

(57) ABSTRACT

A chimney termination cap is provided with a body having a perimeter sidewall with a lower region adapted to be mounted to a chimney. The body has an opening for venting the chimney. A lid is mounted to a top of the body. A tray is mounted within the body for collecting precipitation. One of the body and the tray includes a drainage aperture for draining the precipitation from the tray. In one embodiment, the chimney termination cap includes an integrated slip-sleeve configured to receive a chimney flue or vent pipe.

17 Claims, 4 Drawing Sheets

U.S. PATENT DOCUMENTS 3,874,363 A * 4/1975 Biedenbender et al. ... 126/85 B
4,191,099 A 3/1980 Strahl
4,200,038 A * 4/1980 Briner et al. ..... 454/8
4,387,628 A 6/1983 Sapp
4,398,453 A * 8/1983 Wilkerson ..... 454/367
4,436,021 A 3/1984 Hisey
4,522,191 A 6/1985 Knowles et al.
4,548,137 A 10/1985 Lane
4,580,548 A 4/1986 Ono
4,655,121 A * 4/1987 Ludwig ..... 454/3
5,562,088 A 10/1996 Valters et al.
6,647,977 B2 11/2003 Lesage
6,926,600 B1 8/2005 Arnold, Jr.
2004/0154610 A1 8/2004 Hopp

FOREIGN PATENT DOCUMENTS

JP 60152815 A * 8/1985

* cited by examiner

CHIMNEY TERMINATION CAP

BACKGROUND

1. Technical Field

The multiple embodiments of the present invention relate to a chimney termination cap assembly for a chimney having a flue or vent pipe.

2. Background Art

Chimney flue and vent termination cap assemblies are available in a variety of different shapes and sizes. Generally, the chimney termination cap assembly must be attached to the chimney flue or vent pipe end and/or the roof, chase, or exterior walls from which the chimney flue or vent pipe extends. With more ornamental termination caps, an effort is typically made to conceal the structures required for making the necessary attachments.

European style termination cap assemblies, such as the one illustrated in U.S. Pat. No. 6,926,600 which issued on Aug. 9, 2005, each have a lower housing portion that generally extends from the roof top of the top of the chase from which the chimney flue or vent pipe extends. This European style of termination cap assemblies can be contrasted with those that have no such lower housing portion, such as the one illustrated in U.S. Pat. No. 4,436,021 which issued on Mar. 13, 1984.

SUMMARY

In one embodiment, a chimney termination cap assembly is provided with a body having a perimeter sidewall with a lower region adapted to be mounted to a chimney. The body has at least one opening for venting the chimney. A lid is mounted to a top of the body. At least one tray is mounted within the body for collecting precipitation. One of the body and the at least one tray includes at least one drainage aperture for draining the precipitation from the tray.

In another embodiment, the chimney termination cap assembly includes an integrated slip-sleeve configured to receive a chimney flue or vent pipe.

DETAILED DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
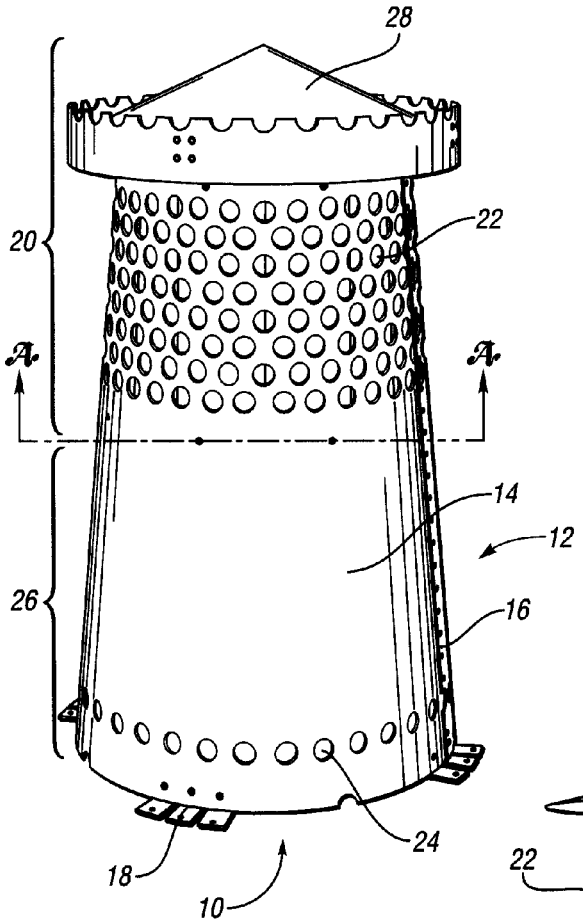
FIG. 1 is a perspective view of an embodiment of a chimney termination cap assembly.
Figure 2:
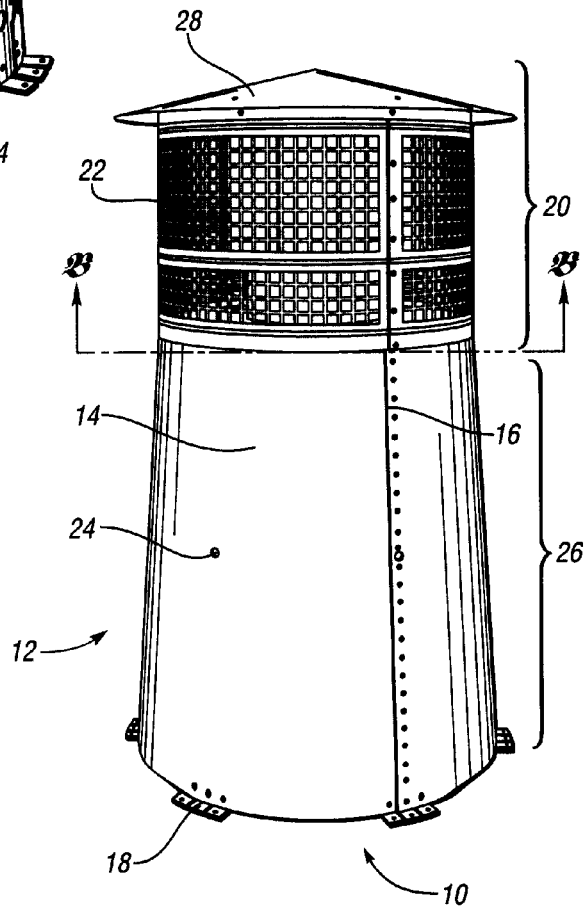
FIG. 2 is a perspective view of another embodiment of a chimney termination cap assembly.

In FIG. 1, a chimney termination cap assembly is illustrated and generally referenced by the numeral 10. In FIG. 2, another embodiment of a chimney termination cap assembly is also illustrated and generally referenced by the number 10. In FIGS. 1 and 2, the designs of the chimney termination cap assemblies 10 are shown for purposes of depicting features of the embodiments of the present invention, and are not intended to limit the scope of chimney termination cap assemblies 10 designs (ornamental and non-ornamental) in which the multiple embodiments of the present invention may be implemented.

The chimney termination cap assemblies 10 each include a body 12. The bodies 12 each have a sidewall 14 that is fabricated from sheet metal such as steel, aluminum, copper, etc. or any other suitable material. The sidewalls 14 may have a generally tapered shape and may also have a variety of different cross-sectional configurations. Examples of cross-sectional configurations are constant or tapered (such as the circular cross-section illustrated in FIGS. 1 and 2). Cross-sectional configurations may include circles, squares, rectangles, octagons, or any other suitable shape. In one embodiment, the sidewalls 14 form a frusto-conical shape. The sidewalls 14 may have any ornamental design or finish. The sidewalls 14 may comprise one member or piece of sheet metal affixed at opposing ends by a seam 16 employing fasteners including but not limited to rivets, sheet metal screws. The material may also be welded or extruded to form a unitary sidewall 14 construction.

Flanges 18 may be provided at the base of the sidewalls 14 for affixing the chimney termination cap assemblies 10 to a rooftop, chase, sidewall or other surface. Adjustable flanges 18 for leveling or otherwise adjusting the orientation or height of the chimney termination cap assembly 10 may also be utilized.

The upper portion 20 of each of the chimney termination cap assemblies 10 include a plurality of vents 22. Vents 22 may be a variety of different shapes including circles, squares, rectangles, louvers, etc. Vents 22 or other sidewall openings 24 may also be provided in a lower portion 26 of the chimney termination cap assembly 10. The openings 24 may be provided for aesthetics, to enhance the draft performance of the chimney termination cap assembly 10, or as explained below, to access a clamp or other fastener for securing the chimney termination cap assembly 10 to a chimney flue or vent pipe. The openings 24 may also be provided, as explained in later embodiments, for draining precipitation from within the body 12 of the chimney termination cap assembly 10.

The upper portions 20 of the chimney termination cap assemblies 10 also include a lid 28 generally defining a cover for the chimney termination cap assembly 10. The lid 28 may be permanently fastened to the sidewall by rivet, weld, or the like. Alternately, the lid 28 may be removable from, hinged to or otherwise releaseably fastened to the upper portion 20 of the sidewall 14, which permits the lid 28 to be opened or removed for cleaning or other maintenance. The lid 28 may have a flat, conical, pitched or dome-like shape, or any other suitable configuration. Like the sidewall 14 and the vents 22, the lid 28 may bear any ornamental design or finish.

Figure 3:
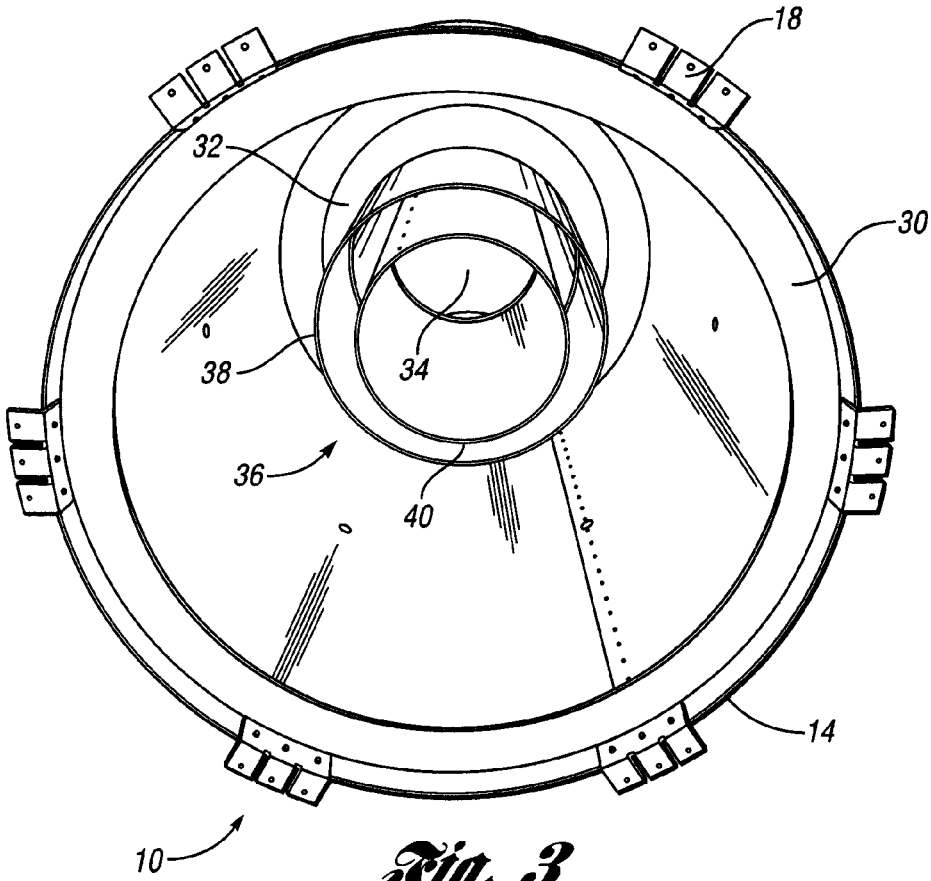
FIG. 3 is a bottom perspective view of the chimney termination cap assembly of FIG. 2.

Referring now to FIG. 3, a perspective bottom view of the chimney termination cap assembly 10 of FIG. 2 is illustrated. The flanges 18 are arranged about the exterior perimeter of the lower portion 26 of the sidewall 14. A reinforcing rib 30 may be affixed to the interior perimeter of the lower portion 26 of the sidewall 14. Like the other components of the chimney termination cap assembly 10, the flanges 18 and reinforcing rib 30 may be affixed using rivets, screws, welds, or other suitable fasteners.

A platform 32 is affixed to and extends perpendicular from the interior of the sidewall 14, generally defining an upper portion 20, as illustrated in FIGS. 1 and 2, and a lower portion 26 of the chimney termination cap assembly 10. In one embodiment, the platform 32 is utilized as a tray 32 to drain precipitation, which is discussed in later embodiments. Imaginary lines A-A (FIG. 1) and B-B (FIG. 2) approximate the location of the platform 32 with respect to the chimney termination cap assembly 10. Of course, the location of the platform 32 can vary. The platform 32 may be of sheet metal or other suitable composition. The platform 32 may define a vent hole 34 through which exhaust gasses from a chimney will pass during operation of the chimney termination cap assembly 10. In accordance with the present embodiment, exhaust gasses received from a chimney flue or vent pipe pass through the vent hole 34 and out of the chimney termination cap assembly 10 through vents 22 located in the upper portion 20 of the sidewall 14. Additional venting may be arranged elsewhere within or associated with the platform 32, or the lower portion 26 of the chimney termination cap assembly 10, to enhance drafting.

As illustrated, a slip-coupling 36 extends from the platform 32. The slip-coupling 36 has a concentric outer sleeve 38 and inner sleeve 40. The outer sleeve 38 and inner sleeve 40 are sufficiently spaced from one another to receive the end of a circular chimney flue or vent pipe (not shown). Of course, the cross-sectional geometry of the slip-coupling 36 is not limited to a circle. The cross sectional geometry may vary depending on the geometry of the chimney flue or vent pipe that the slip-coupling 36 is intended to receive. Other geometries include but are not limited to a square and a rectangle.

In one embodiment, the receiving end of the slip-coupling 36 is the end opposite the end attached to the platform 32 and terminates prior to the base or bottom surface of the chimney termination cap assembly 10. The length of the slip-coupling 36 is sufficient to couple and receive the chimney flue or vent pipe such that exhaust gasses pass through vent aperture 34 during the normal operation of the chimney termination cap assembly 10, and not through the slip-coupling 36.

Figure 4:
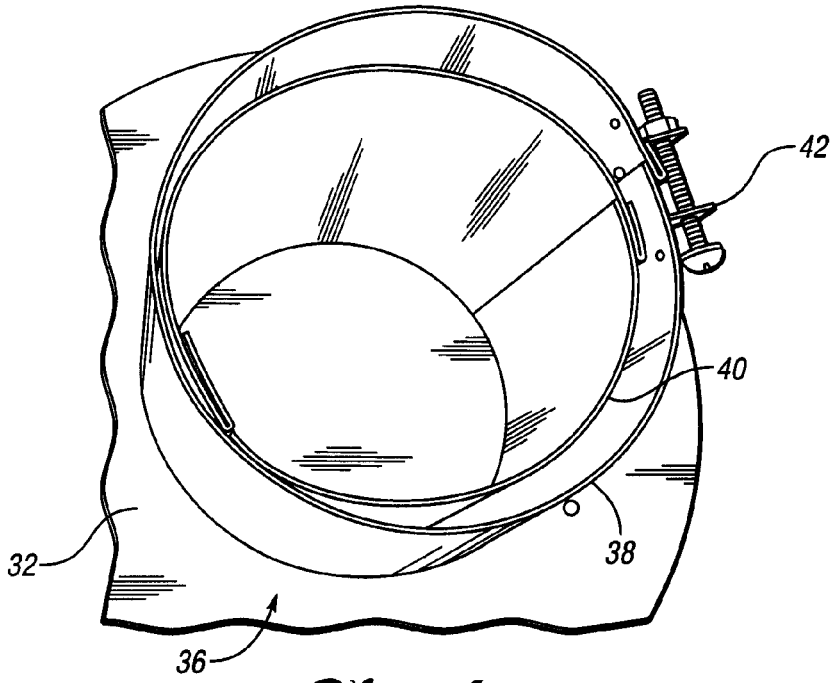
FIG. 4 is a partial bottom perspective view of another embodiment of the chimney termination cap assembly of FIG. 2.

Referring now to FIG. 4, another embodiment of a slip-coupling 36 is illustrated. The slip-coupling 36 includes a pair of concentric cylinder sleeves 38 and 40 extending from the platform 32. The outer sleeve 38 includes a clamp 42 for tightening the outer sleeve 38 to the chimney flue or vent pipe that is received by the coupling 36. Other known clamps 42 may be implemented. Access for tightening or un-tightening the clamp 42 may be provided by sidewall openings 24 in the sidewall 14 illustrated in FIGS. 1 and 2, respectively.

Figure 5:
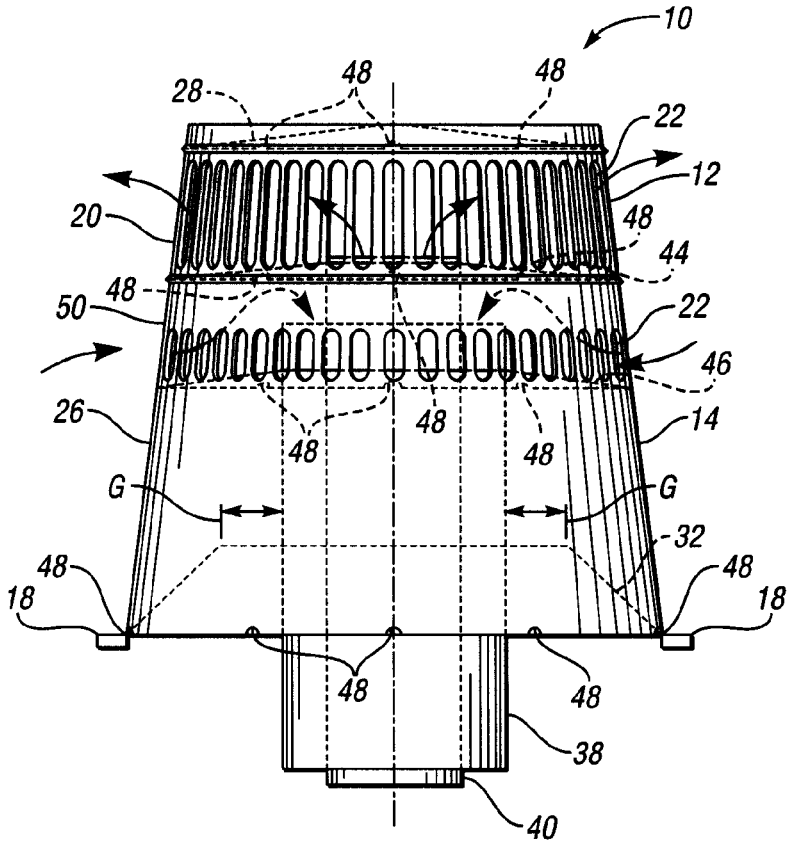
FIG. 5 is a side elevation view of another embodiment of a chimney termination cap assembly.
Figure 6:
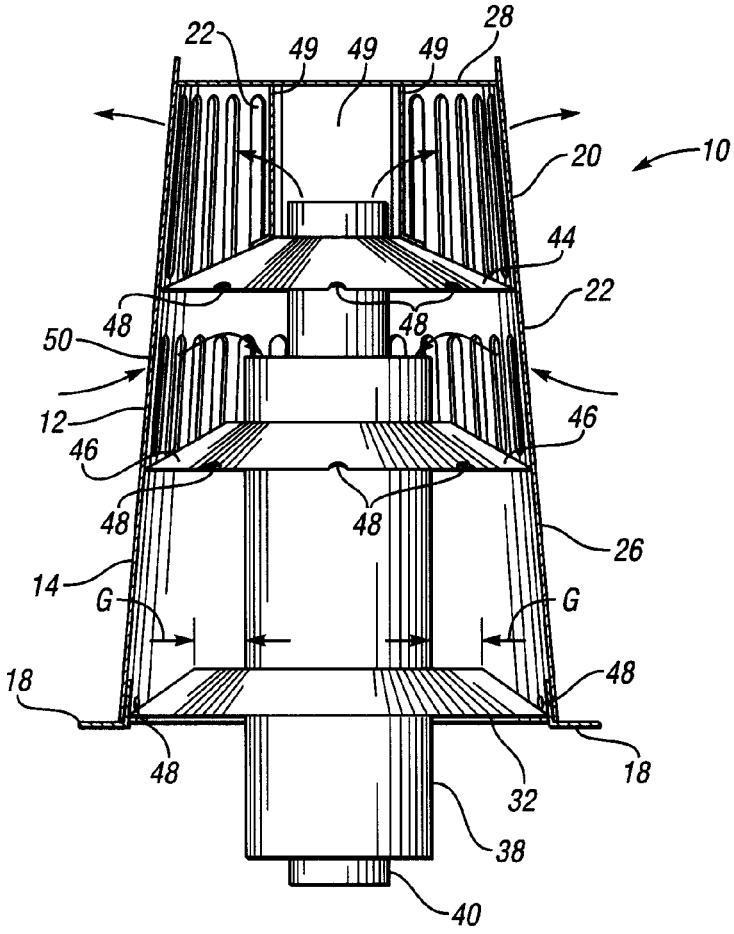
FIG. 6 is a section view the chimney termination cap assembly of FIG. 5.

With reference now to FIGS. 5 and 6, a chimney termination cap assembly is illustrated and generally referenced by the numeral 10. The chimney termination cap assembly 10 has a body 12 with a sidewall 14 which is generally tapered. In the illustrated embodiment, the sidewall 14 has a frusto-conical shape. The body 12 has an upper portion 20 which is bounded by the sidewall 14, a lid 28, and an upper tray 44. The upper portion 20 has an inner sleeve 40 which may be connected to an exhaust pipe of a chimney flue or vent pipe (not shown). The inner sleeve 40 ventilates the chimney flue or vent pipe which the chimney termination cap assembly 10 is installed upon. The body 12 has a middle portion 50 which is bounded by the sidewall 14, the upper tray 44 and a middle tray 46. The middle portion 50 has an outer sleeve 38 which may be connected to an intake pipe of a chimney flue or vent pipe. The body 12 has a lower portion 26 which is bounded by the sidewall 14, the middle tray 46 and a lower tray 32. The lower portion 26 may attach the chimney termination cap assembly 10 to the chimney flue or vent pipe. The chimney termination cap assembly 10 may have additional trays or may have fewer trays as desired for a particular application.

The chimney termination cap assembly 10 has an air intake so that air flows into the middle portion 50 through the vents 22 and into the outer sleeve 38 and into the connected chimney flue or vent pipe. This intake of the air is depicted by the arrows pointing toward the center of the chimney termination cap assembly 10. At the same time, air also flows out of the chimney flue or vent pipe, into the inner sleeve 40, into the upper portion 20 and out of the chimney termination cap assembly 10 through the vents 22. This exhaust of air is depicted by the arrows pointing away from the center of the chimney termination cap assembly 10.

In the illustrated embodiments, the lid 28 has a center which is generally inclined. The inclined center of the lid 28 directs precipitation that falls on the chimney termination cap assembly 10 toward the sidewall 14. Multiple drainage apertures 48 drain away precipitation that may fall on the chimney termination cap assembly 10 during use of the chimney termination cap assembly 10. The drainage apertures 48 are located adjacent to the sidewall 14 for directing the precipitation to drain off of the lid 28 of the chimney termination cap assembly 10. Any desired amount of drainage apertures 48 may be formed on the lid 28.

Precipitation that is directed off of the lid 28 falls into the upper portion 20 of the body 12. Additional precipitation may enter the upper portion through the vents 22. The upper tray 44 is connected to the inner sleeve 40 and the sidewall 14 to direct all of the precipitation away from the center to drain the precipitation. Draining the precipitation avoids having standing precipitation within the chimney termination cap assembly 10 which can leak into the chimney and/or damage the connections within the chimney termination cap assembly 10. Draining the precipitation also avoids an ice build-up during colder temperatures which can damage the connections within the chimney termination cap assembly 10. In one embodiment, the upper tray 44 has an inclined center so that the precipitation is directed towards the sidewall 14. The central incline of the upper tray 44 may have a sufficient angle so that the additional precipitation entering through the vents 22 rebound back through the vents 22. The upper tray 44 is illustrated with multiple drainage apertures 48 and any desired amount of drainage apertures 48 may be utilized. The drainage apertures 48 in the upper tray 44 are located adjacent to the sidewall 14 to direct all of the precipitation to drain off of the upper tray 44 and out of the upper portion 20 of the chimney termination cap assembly 10.

The precipitation that is directed out of the upper portion 20 falls into the middle portion 50 of the body 12. In addition, precipitation may enter the upper portion through the vents 22. The middle tray 46 is connected to the outer sleeve 38 and the sidewall 14 to direct all of the precipitation outward to drain the precipitation. Draining the precipitation avoids standing precipitation and/or ice build-up within the chimney termination cap assembly 10 to prevent the precipitation from leaking into the chimney and/or from damaging the connections within the chimney termination cap assembly 10. The middle tray 46 may have an inclined center so that the precipitation is directed towards the sidewall 14. The central incline of the middle tray 46 may have an adequate incline so that the additional precipitation entering through the vents 22 rebound back through the vents 22. The middle tray 46 is illustrated with multiple drainage apertures 48 and may have any suitable amount of drainage apertures 48. The drainage apertures 48 in the middle tray 46 are located adjacent to the sidewall 14 to direct all of the precipitation to drain off of the middle tray 46 and out of the middle portion 50 of the chimney termination cap assembly 10.

Referring to FIG. 6, baffles 49 are illustrated within the upper portion 20 of the chimney termination cap assembly 10. The baffles 49 are connected on one end to the upper tray 44 and on a second end to the lid 28. The arrangement of the baffles 49 within the upper portion 20 aid in preventing precipitation and/or other debris from entering the inner sleeve 40 while still allowing air to flow out of the inner sleeve 40 and the upper portion 20. Any suitable known baffle 49 or known system of baffles 49 my be utilized within the scope of the multiple embodiments of the present invention.

Figure 7:
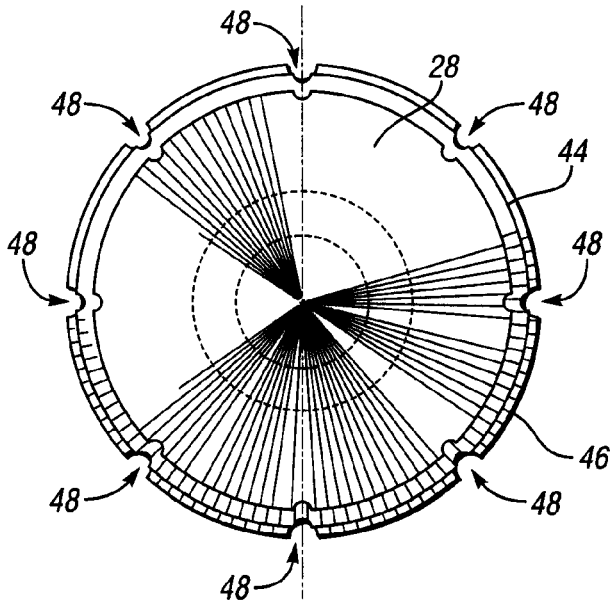
FIG. 7 is a top plan view of multiple trays of the chimney termination cap assembly of FIG. 5.

With reference to FIG. 7, multiple drainage apertures 48 in the lid 28, the upper tray 44 and the middle tray 46 align with each other to allow precipitation to pass through the upper portion 20 and the middle portion 50 efficiently and effectively. Any suitable amount of drainage apertures 48 located on each of the lid 28, the upper tray 44 and the middle tray 46 may align with each other. Alignment of the drainage apertures 48 in the lid 28, the upper tray 44 and the middle tray 46 allows precipitation to drain efficiently and effectively along the tapered sidewall 14 of FIG. 5. The drainage apertures 48 in the middle tray 46 may be larger than the drainage apertures 48 in the upper tray 44 and the lid 28 and the drainage apertures 48 in the upper tray 44 may be larger than the drainage apertures 48 in the lid 28 to facilitate efficient movement of the precipitation.

Figure 8:
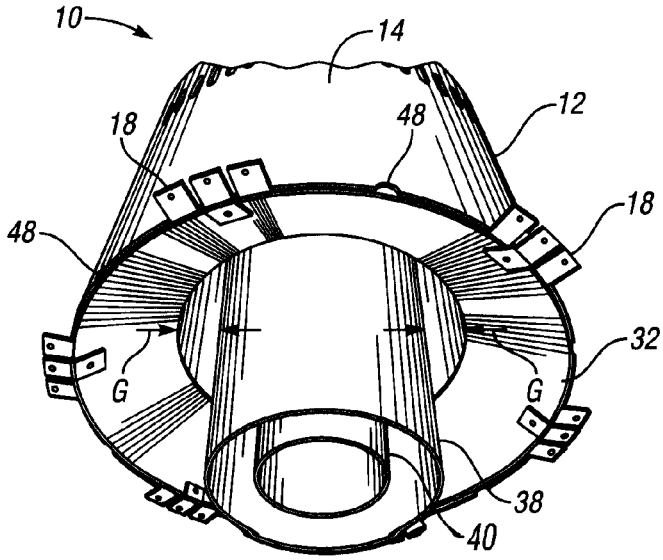
FIG. 8 is a bottom perspective view of the chimney termination cap assembly of FIG. 5.

Referring now to FIGS. 5, 6 and 8, the lower tray 32 is connected to the sidewall 14. There is a gap G between the lower tray 32 and the outer sleeve 38 to facilitate installation of the chimney termination cap assembly 10. The gap G is small enough to allow the lower tray 32 to collect precipitation which falls from the middle portion 50 of the body 12. The lower tray 32 may be centrally inclined to direct precipitation toward the sidewall 14. Where the sidewall 14 and the lower tray 32 connect, the sidewall 14 may have multiple drainage apertures 48. The drainage apertures 48 direct the precipitation externally from the chimney termination cap assembly 10, which protects the chimney flue or vent pipe (not shown) from the precipitation and drains the precipitation to avoid standing precipitation and/or ice build-up within the chimney termination cap assembly 10 as discussed above. The drainage apertures 48 in the sidewall 14 may be larger than the drainage apertures 48 in the lid 28, upper tray 44 and/or middle tray 46 to better facilitate efficient movement of the precipitation through the chimney termination cap assembly 10.

The body 12 is generally tapered from top to bottom of the chimney termination cap assembly 10 so that precipitation draining through the corresponding drainage apertures 48 in the lid 28, the upper tray 44, and the middle tray 46 drains along the tapered sidewall 14 by capillary action which directs the precipitation outward as the precipitation drains. The capillary action of the draining precipitation minimizes the amount of precipitation which remains within the chimney termination cap assembly 10 and facilitates efficient drainage of the chimney termination cap assembly 10.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A chimney termination cap assembly comprising:

a body having a perimeter sidewall with a lower region adapted to be mounted to a chimney, the body having at least one opening for venting the chimney;

a lid mounted to a top of the body, the lid having at least one drainage aperture formed therethrough proximate the perimeter sidewall;

at least one tray mounted within the body for collecting precipitation and including at least one drainage aperture formed therethrough and aligned with the at least one drainage aperture formed through the lid for draining the precipitation from the lid to the at least one tray;

a coupling mounted to the at least one tray adapted to receive a chimney pipe end, wherein the body opening is oriented adjacent to the coupling; and a base tray mounted to the lower region of the body for collecting precipitation being centrally inclined for directing the precipitation externally from the chimney termination cap assembly;

wherein one of the body and the base tray includes at least one drainage aperture oriented adjacent to a lower periphery of the sidewall for draining the precipitation from the base tray.

2. The chimney termination cap assembly of claim 1 wherein the at least one tray is centrally inclined and the at least one drainage aperture is oriented adjacent to the sidewall for directing the precipitation externally from the chimney termination cap assembly.

3. The chimney termination cap assembly of claim 1 wherein the at least one tray is frusto-conical for directing the precipitation externally from the chimney termination cap assembly.

4. The chimney termination cap assembly of claim 1 wherein the body, the lid and the at least one tray are each formed from sheet metal.

5. The chimney termination cap assembly of claim 1 wherein the sidewall is generally tapered for draining precipitation by capillary action along the inside of the sidewall to the lower region.

6. The chimney termination cap assembly of claim 1 wherein the lower periphery aperture is formed through the sidewall.

7. The chimney termination cap assembly of claim 6 wherein the lower periphery aperture is aligned with the at least one drainage aperture formed in the at least one tray.

8. The chimney termination cap assembly of claim 1 further comprising:

a second tray mounted within the body spaced apart from the at least one tray; and a second coupling mounted to the second tray adapted to receive another chimney pipe end, wherein a second opening is formed through the sidewall adjacent to the second coupling.

9. The chimney termination cap assembly of claim 8 wherein the second tray is frusto-conical.

10. The chimney termination cap assembly of claim 8 wherein the first coupling further comprises a first sleeve sized to receive the first chimney pipe end; and wherein the second coupling further comprises a second sleeve sized to receive the second chimney pipe end.

11. The chimney termination cap assembly of claim 1 wherein the at least one drainage aperture is formed through the base tray.

12. The chimney termination cap assembly of claim 11 wherein the at least one drainage aperture formed though the base tray is aligned with the at least one drainage aperture formed in the at least one tray.

13. A chimney termination cap assembly comprising:

a body having a perimeter sidewall with a lower region adapted to be mounted to a chimney, the body having at least one opening for venting the chimney;

a lid mounted to a top of the body, the lid having at least one drainage aperture formed therethrough proximate the perimeter sidewall;

at least one tray mounted within the body for collecting precipitation and including at least one drainage aperture formed therethrough and aligned with the at least one drainage aperture formed through the lid for draining the precipitation from the lid to the at least one tray;

a coupling mounted to the at least one tray adapted to receive a chimney pipe end, wherein the body opening is oriented adjacent to the coupling;

a second tray mounted within the body spaced apart from the at least one tray; and a second coupling mounted to the second tray adapted to receive another chimney pipe end, wherein a second opening is formed through the sidewall adjacent to the second coupling;

wherein the second tray includes at least one drainage aperture for draining the precipitation from the second tray.

14. The chimney termination cap assembly of claim 13 wherein the second tray is centrally inclined and the at least one drainage aperture in the second tray is oriented adjacent to the sidewall for directing the precipitation externally from the chimney termination cap assembly.

15. The chimney termination cap assembly of claim 13 wherein the second tray is oriented beneath the first tray such that precipitation that drains from the first tray through the at least one drainage aperture formed therethrough and is subsequently collected by the second tray and then drains from the second tray through the at least one drainage aperture formed through the second tray.

16. The chimney termination cap assembly of claim 13 wherein the at least one drainage aperture formed through the second tray is aligned with the at least one drainage aperture formed in the at least one tray.

17. A chimney termination cap assembly comprising:

a body having a perimeter sidewall with a lower region adapted to be mounted to a chimney, the body having at least one opening for venting the chimney;

a lid mounted to a top of the body;

a first centrally inclined tray mounted within the body for collecting precipitation and directing the precipitation outboard, wherein the first tray includes at least one drainage aperture oriented adjacent to the sidewall for draining the precipitation from the first tray;

a second centrally inclined tray mounted within the body spaced apart from the first tray for collecting precipitation and directing the precipitation outboard, wherein one of the body and the second tray includes at least one drainage aperture oriented adjacent to the sidewall and aligned with the at least one drainage aperture in the first tray for draining the precipitation from the second tray; and a centrally inclined base tray mounted to the lower region of the body for collecting precipitation and directing the precipitation outboard, wherein one of the body and the base tray includes at least one drainage aperture oriented adjacent to a lower periphery of the sidewall and aligned with the at least one drainage aperture in the second tray for draining the precipitation from the base tray.

* * * * *